US005826756A

United States Patent [19]

Foster

[11] Patent Number: 5,826,756

[45] Date of Patent: Oct. 27, 1998

[54] WATER SHIELD FOR PUMP DISPENSER

[75] Inventor: Donald D. Foster, St. Charles, Mo.

[73] Assignee: Continental Sprayers International, Inc., St. Peters, Mo.

[21] Appl. No.: 891,540

[22] Filed: Jul. 11, 1997

Related U.S. Application Data

[63] Continuation-in-part of Ser. No. 612,667, Mar. 8, 1996, Pat. No. 5,725,128.

[51] Int. Cl.[6] ..... B65D 88/54

[52] U.S. Cl. ..... 222/321.3; 222/321.9

[58] Field of Search ..... 222/523, 321.3, 222/321.7, 321.9

[56] References Cited

U.S. PATENT DOCUMENTS

| | | | |
|---|---|---|---|
| 3,362,344 | 1/1968 | Duda . | |
| 5,458,289 | 10/1995 | Cater . | |
| 5,464,129 | 11/1995 | Ho . | |
| 5,476,196 | 12/1995 | Saito et al. . | |
| 5,497,915 | 3/1996 | Wass . | |
| 5,524,793 | 6/1996 | O'Neill . | |
| 5,642,908 | 7/1997 | Mascitelli | 222/321.9 |

*Primary Examiner*—Gregory L. Huson
*Attorney, Agent, or Firm*—Howell & Haferkamp, L.C.

[57] ABSTRACT

A manually operated liquid dispenser having two telescoping sleeves shielding the dispenser fluid passageways from dilution and/or contamination of the fluid being dispensed by a fluid splashed on the exterior of the dispenser.

20 Claims, 4 Drawing Sheets

WATER SHIELD FOR PUMP DISPENSER

This application is a continuation-in-part of application Ser. No. 08/612,667, filed Mar. 8, 1996 and U.S. Pat. No. 5,725,128.

BACKGROUND OF THE INVENTION

This invention relates generally to manually operated liquid dispensers, and more specifically to manually operated liquid dispensers for use in wet environments where contamination and/or dilution of the fluid being dispensed is a cause for concern, such as in the dispensing of soaps and lotions.

A typical manually operated liquid dispenser invariably has the following features: a pump chamber containing a reciprocating liquid pump, a dip tube in fluid communication with the pump chamber, a plunger mounted on the pump chamber, a spring biasing the plunger toward an extended or charge position of the plunger relative to the pump chamber, and a cap having a configuration for attachment to a container holding a liquid. The user typically operates the pump by activating a pump dispensing head or pump actuating element connected to the plunger. When depressed by the user, the dispensing head or pump actuating element causes the plunger to descend into an interior of the pump chamber, discharging fluid in the pump chamber interior, through a priming valve into a plunger fluid passageway and ultimately out a fluid discharge port. When the user releases the pump dispensing head or pump actuating element, the plunger is biased by the spring to the pump charge position, thereby drawing fluid from the container through the dip tube, through a check valve and into the pump chamber interior. This cycle is repeated until the contents of the container are dispensed.

This type of manually operated liquid dispenser has proved especially popular in dispensing soaps and lotions. Consequently, it is often used in close proximity to running water, and is increasingly being used in showering facilities. Thus, manually operated liquid dispensers are commonly used in applications where they are subject to being splashed, and are often operated with wet hands. Conventional manually operated liquid dispensers are not designed for this type of environment, and are consequently susceptible to contamination.

For example, various embodiments of liquid and/or lotion dispensers in the art are described and illustrated in U.S. Pat. Nos. 3,362,344, 5,524,793, 5,458,289, 5,464,1049, 5,476,196 and 5,497,915, among others. Despite the variety of shapes and features employed, they are all vulnerable to fluid leakage into the pump chamber from the exterior of the dispenser. When used in wet environments, water splashed on the upper dispenser exterior strikes the dispenser and flows downward along the outer surface of the dispenser. As a result, water may penetrate the sliding connection between the plunger and the pump chamber, especially when the plunger is in its extended or charge position relative to the pump chamber. Water running down the plunger exterior surface pools at the sliding connection of the plunger to the pump chamber where the plunger enters the pump chamber and, as a result, invariably seeps into the pump chamber. Once a fluid enters the pump chamber, at best the fluid mixes with the fluid being dispensed and is discharged with the fluid being dispensed, or at worst, it leaks through the check valve into the fluid container. Depending on the integrity of the fluid penetrating the dispenser, the effect may range from mere dilution to dangerous contamination of the fluid being dispensed. Over time, this can lead to a noticeable drop in the quality of the fluid being dispensed.

SUMMARY OF THE INVENTION

Among the several objects of the present invention may be noted the provision of an improved manually operated liquid dispenser having a water shield of a relatively simple construction to prevent dilution and/or contamination of the fluid being dispensed. A further object of the invention is the provision of a method for shielding a liquid dispenser from fluid penetration of the dispenser fluid passageway.

Generally, the manually operated liquid dispenser of the present invention comprises a pump chamber, a dip tube in fluid communication with the pump chamber, a plunger mounted on the pump chamber, a dispensing head or pump actuating element attached to the plunger to operate the pump, a first sleeve mounted to the pump chamber, and a second sleeve mounted to the plunger. The plunger is mounted on the pump chamber for reciprocating movement between a charge and discharge position of the plunger relative to the pump chamber. The first sleeve is mounted stationary relative to the pump chamber and surrounds the plunger. The second sleeve is mounted stationary relative to the plunger for reciprocating movement with the plunger. The second sleeve telescopes with the first sleeve in response to the plunger reciprocating between the charge and discharge positions.

The invention provides a method of shielding liquid from dilution or contamination in a liquid dispenser having a dip tube communicating with a pump chamber, a plunger mounted on the pump chamber for reciprocating movement between a charge and a discharge position of the plunger relative to the pump chamber, and a pump actuating element mounted to the plunger.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

The construction and configuration of the various components of the dispenser described and shown is for illustrative purposes only. As will be seen, the thrust of the invention is the provision and application of telescoping sleeves to protect the dispenser from contamination. The focus of the invention is from a plunger upward. Thus, the actual construction and operation of the pump elements are largely inconsequential. Furthermore, although the subject matter of the invention is described as being applied to a manually operated reciprocating liquid pump in which the pump plunger reciprocates vertically relative to the pump housing in usual operation, the subject matter of the invention is also equally well suited for use on other types of manually operated pumps such as trigger sprayer pumps. The invention may therefore be practiced with a wide variety of lotion pumps and different types of sprayers. Accordingly, it is to be understood that liquids other than soaps or lotions may be dispensed via the invention without departing from the scope of the invention.

Figure 1:
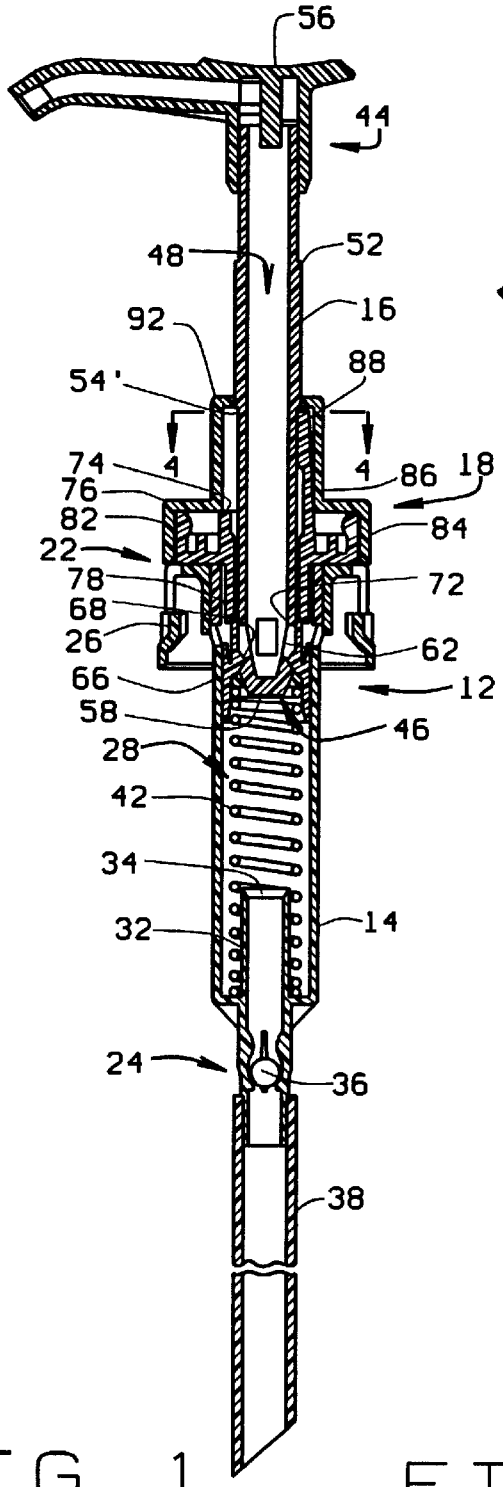
FIG. 1 is an in section elevation view of the pump of the invention in its upwardly extended or charge position.

Referring to FIG. 1, the manually operated reciprocating liquid pump 12 of the invention is basically comprised of a pump housing 14, a plunger 16 received in the pump housing for reciprocating movement relative thereto, and a lock mechanism 18 mounted on the pump housing and surrounding the plunger. The plunger is also provided with seals that seal close liquid communication through the pump in both the upwardly extended, charge position and downwardly inserted, discharge position of the plunger relative to the pump housing.

The pump housing 14 has a general cylindrical configuration with opposite top 22 and bottom 24 ends and a hollow interior bore extending completely through the housing between its opposite ends. The top end 22 of the housing is formed with a connector 28 for connecting the liquid pump to a liquid container. The connector 28 shown is a bayonet-type snap on connector, however, a screw threaded cap may also be employed as the connector.

Below the connector 28 the interior bore of the pump housing is formed as a pump chamber 28. At the bottom of the pump chamber is a column 32 extending upwardly from the pump chamber floor. The column has a liquid inlet opening 34 at its top that conducts liquid into the pump chamber from the column. Contained inside the column 32 and below the pump chamber 28 is a ball check valve 36. The ball check valve 36 permits liquid flow through the column 32 into the pump chamber 28, but prevents the reverse flow of liquid from the pump chamber through the column. Connected to the lower most end of the column 32 below the check valve 36 is a dip tube 38. The dip tube extends to the bottom of the liquid container when the pump 12 is attached to the container and conducts liquid from the container to the interior of the pump housing.

A coil spring 42 is contained in the pump chamber 28 of the pump housing. The coil spring has a coil diameter slightly larger than the column 32 so that it passes over the column and rests on the bottom of the pump chamber.

The plunger 16 passes through the top of the pump housing 14 and into the pump chamber 28. The plunger has a generally cylindrical configuration with opposite top 44 and bottom 46 ends and an interior bore 48 extending through the plunger between its opposite ends. The plunger has a substantially continuous cylindrical surface between its opposite ends except for an upper annular shoulder 52 and a lower annular shoulder 54 that surround the plunger exterior surface. The upper shoulder is spaced from the lower shoulder and the distance between the two shoulders corresponds roughly to the distance of the plunger stroke in the pump housing. The exterior cylindrical surface of the plunger is substantially continuous between the upper and lower shoulders. A dispensing head 56 is attached to the top 44 of the plunger, and a sealing plug 58 is attached to the bottom 46 of the plunger. The sealing plug 58 has a periphery that is configured and dimensioned to seat in sealing contact over the liquid inlet opening 34 at the top of the column 32, thus sealing the opening closed. The plug 58 seats over the inlet opening 34 when the plunger is moved to its inwardly inserted, discharge position relative to the pump housing 14. The coil spring 42 engages against the plug 58 at the upper end of the spring and biases the plunger 16 to its upwardly extended, charge position shown in FIG. 1. A plurality of outlet openings 62 extend through the bottom of the plunger just above the sealing plug 58. The outlet openings conduct liquid out of the pump chamber 28 and into the plunger interior bore 48.

Figure 2:
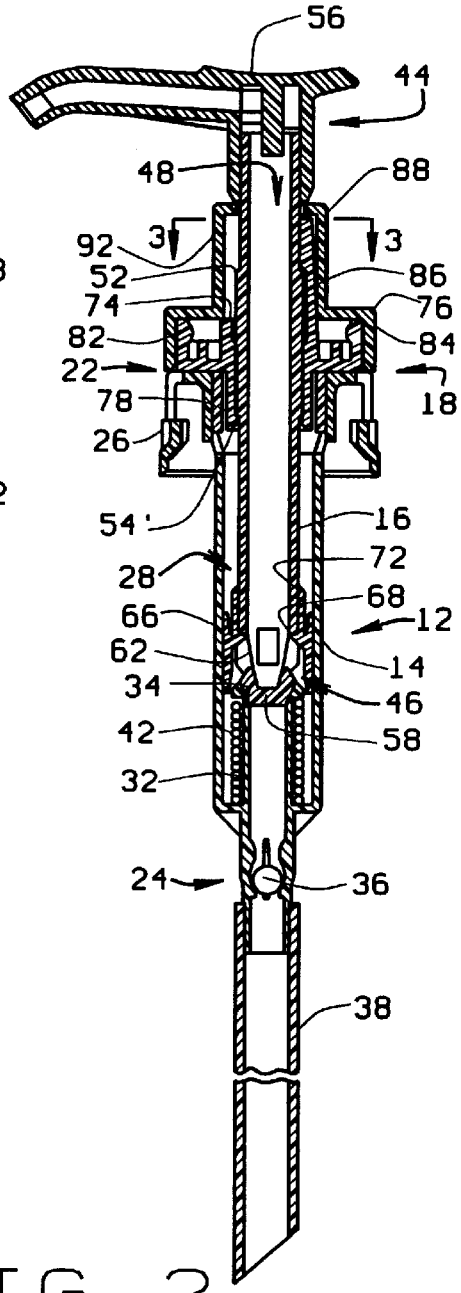
FIG. 2 is an in section view of the pump of FIG. 1 in its downwardly inserted, discharge position.

A piston 66 is mounted on the lower end of the plunger 16 and engages in sliding contact with the interior surface of the pump chamber 28. The piston 66 is mounted on the lower end of the plunger 12 by an annular seal ring 68 that engages around the outlet openings 62 of the plunger. The mounting of the seal ring 68 over the plunger openings 62 allows the ring to move for a limited axial distance over the plunger. The ring may move from the lower ends of the outlet openings 62 shown in FIG. 1, to the upper ends of the outlet openings as shown in FIG. 2. This limited axial movement of the seal ring 68 is caused by the plunger 16 moving the piston 66 downwardly in the pump chamber 28 on a discharge stroke of the plunger, and upwardly in the pump chamber on a charge stroke of the plunger. When the seal ring 68 is positioned at the bottom ends of the outlet openings 62 as shown in FIG. 1, it prevents fluid communication between the pump chamber 28 and the plunger interior bore 48. When the seal ring 68 moves upwardly to where it engages the tops of the outlet openings 62 as shown in FIG. 2, it permits liquid communication between the pump chamber 28 and the plunger interior bore 48. A seal band 72 extends upwardly from the seal ring 68 and overlaps a small portion of the exterior surface of the plunger. The seal band 72 prevents liquid from exiting the plunger interior bore 48 on the upward charge stroke of the plunger by engaging over and closing the outlet openings 62 as shown in FIG. 1.

The lock mechanism 18 is comprised of a base 74 and a lock ring 76. The lock base 74 has a pair of concentric lower annular flanges 78 and an upper annular flange 82. The innermost of the lower annular flanges engages against the seal band 72 of the piston with the plunger moved to its upwardly extended, charge position. This engagement of the inner flange holds the piston in its downward position relative to the plunger and holds the seal ring 68 of the piston in engagement around the plunger sealing plug 58. This seals closed the outlet openings and ensures no leakage of liquid between the pump chamber 28 and the plunger interior bore 48. The outermost of the lower annular flanges 78 has circular ribs on its exterior surface that engage with complimentary shaped ribs on an interior surface of the connector 26. This securely fastens the lock base 74 to the top of the connector. The upper annular flange 82 has an exterior peripheral surface that is engaged in sliding contact by an inner surface of a circular collar 84 at the bottom of the lock ring 76. The engagement of the lock ring collar 84 over the upper annular flange 82 connects the lock ring 76 to the lock base 74 for relative rotational movement.

Figure 3:
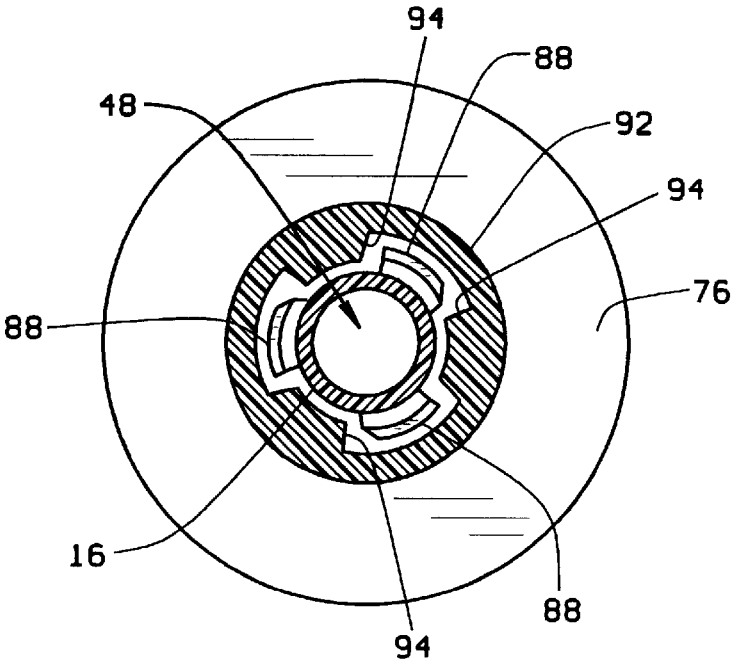
FIG. 3 is a cross section view of the lock mechanism of the pump of FIG. 1 shown in its unlocked condition.
Figure 4:
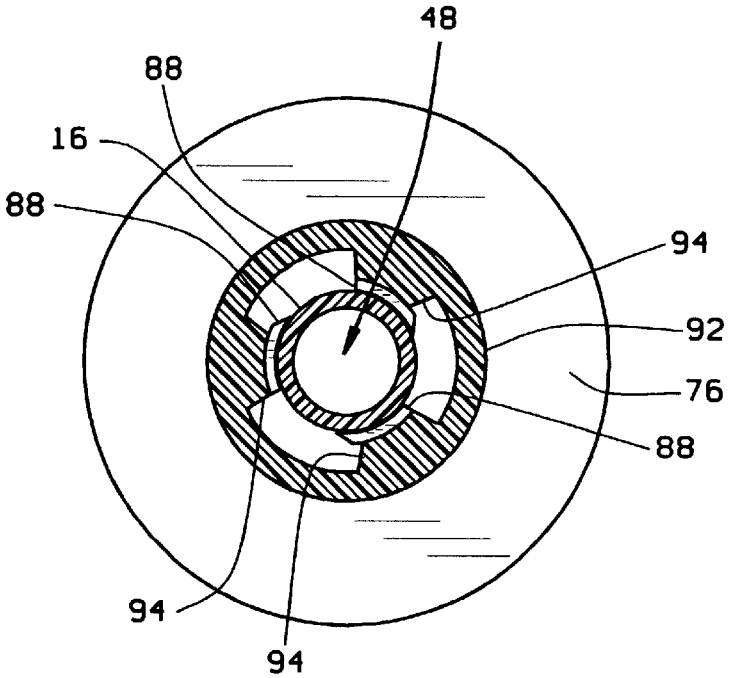
FIG. 4 is a cross section of the lock mechanism of FIG. 1 shown in its locked condition.

Three leaf springs 86 project upwardly from the lock base 74. The leaf springs are spatially arranged around the lock base 74 and the plunger 16 as is best seen in FIGS. 3 and 4.

At the top of each leaf spring is a pawl 88. The leaf springs are resilient and bias the pawls radially away from the plunger exterior surface and out of engagement with the plunger.

A cylindrical knob 92 extends upwardly from the lock ring collar 84. The cylindrical knob has a generally cylindrical interior surface with three cams 94 spatially arranged and projecting radially inwardly from the interior surface. The positioning of the cams is best seen in FIGS. 3 and 4. On rotation of the lock ring 76 relative to the lock base 74, the cams 94 come into engagement with the leaf springs 86 and pawls 88 of the lock base, pushing the leaf springs and pawls radially inwardly so that the pawls engage against the exterior surface of the plunger 16. FIG. 4 shows the knob 92 rotated to the position relative to the lock base 74 where the cams 94 engage the leaf springs 86 and pawls 88 and push them radially inwardly so that the pawls engage the exterior surface of the plunger 16. In this position of the pawls relative to the plunger, the pawls will engage against the upper annular shoulder 52 of the plunger when the plunger is in its inwardly inserted, discharge position relative to the pump housing, and prevent the plunger from moving to its upwardly extended, charge position relative to the housing. Alternatively, with the plunger in its upwardly extended, charge position, the engagement of the pawls 88 against the exterior surface of the plunger 16 and against the lower annular shoulder 54 will prevent the plunger from being moved to its downwardly inserted, discharge position relative to the pump housing. In this manner, the lock mechanism 18 can be selectively, manually operated to lock the plunger in either its downwardly inserted, discharge position or its upwardly extended, charge position relative to the pump housing 14. On rotation of the lock ring 76 relative to the lock base 74 so that the cams 94 move out of engagement with the leaf springs 86 and pawls 88 as shown in FIG. 3, the plunger is free to reciprocate through its full stroke movement between its inwardly inserted, discharge position and its outwardly extended, charge position relative to the pump housing 14.

When the plunger 16 is locked in its downwardly inserted, discharge position relative to the pump housing 14, the sealing plug 58 seats over and closes the liquid inlet opening 34 at the top of the pump column 32, thereby sealing closed the pump and preventing leakage of liquid through the pump. When the plunger is locked in its upwardly extended, charge position relative to the pump housing, the seal ring 68 of the piston 66 is pushed downwardly by the inner most lower annular flange 78 of the lock base 74 and engages around the top surface of the sealing plug 58. The seal band 72 engages over the outlet openings 62 in the plunger and seals closed communication between the pump chamber 28 and the plunger interior bore 48 preventing leakage of liquid through the pump.

Figure 5:
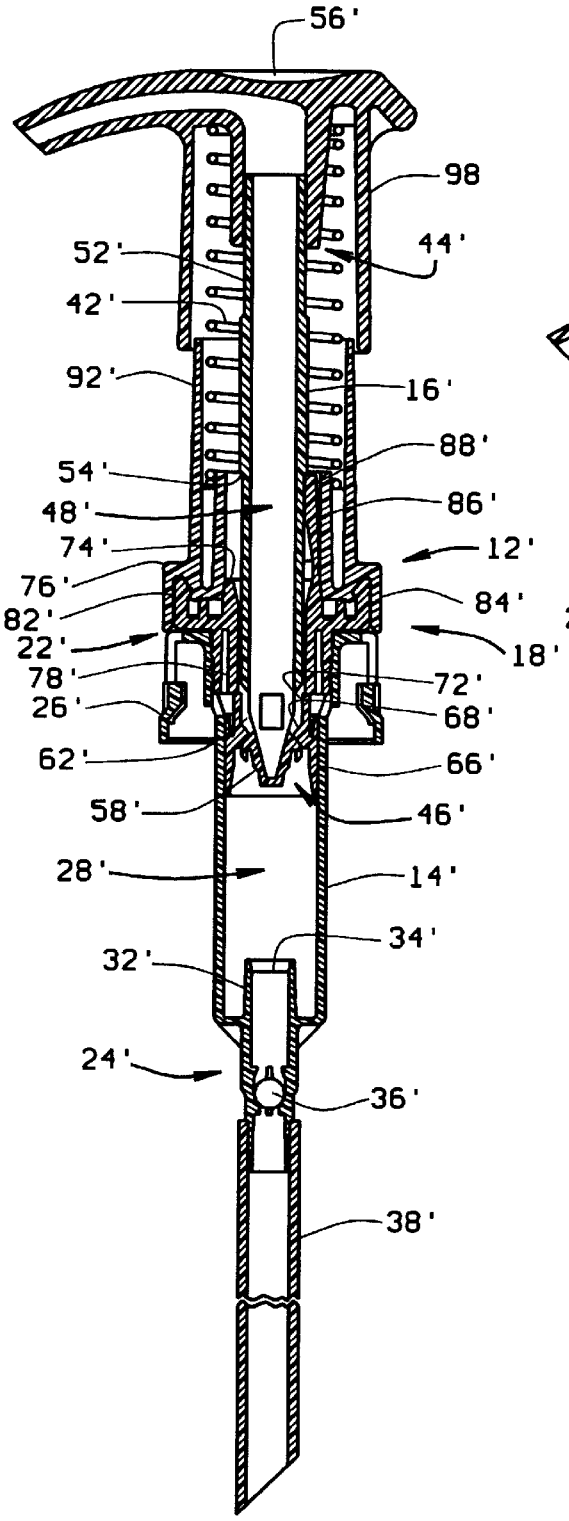
FIG. 5 is an in section elevation view of a second embodiment of the pump in its upwardly extended, charge position.
Figure 6:
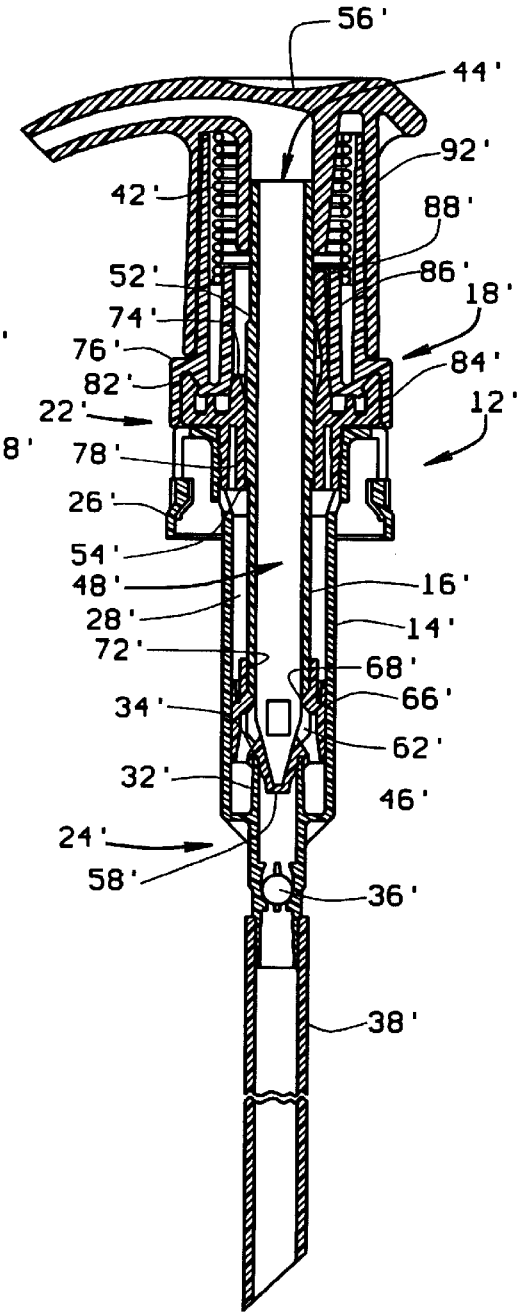
FIG. 6 is an in section elevation view of the pump of FIG. 5 shown in its inwardly inserted, discharge position.

FIGS. 5 and 6 show a second embodiment of the pump of the invention having substantially the same features as the first embodiment. The second embodiment of the pump employs the same lock mechanism 18' and the same seal ring 68' and sealing plug 58' as the first embodiment of the invention. The locking mechanism and sealing ring and plug function in the same manner as the first embodiment of the invention. The only difference between the construction of the pump shown in FIGS. 5 and 6 and that shown and described earlier with reference to FIGS. 1–4 is that the coil spring 96 is positioned outside the fluid flow path through the pump. With this positioning of the coil spring, it does not inhibit the free flow of liquid through the pump. The spring functions in the same manner as that of the previously described embodiment in biasing the plunger 16' to its upwardly extended, charge position relative to the pump housing 14'. Also, the cylinder 92' extends upwardly to a greater extent than the cylindrical knob 92 of the previous embodiment. A second cylinder 98 extends downwardly from the dispensing head 56'; and telescopes over the first cylinder 92', thereby shielding the plunger 16' from its exterior environment in a manner that will be more fully explained with reference to the embodiment of FIGS. 7 and 8.

Figure 7:
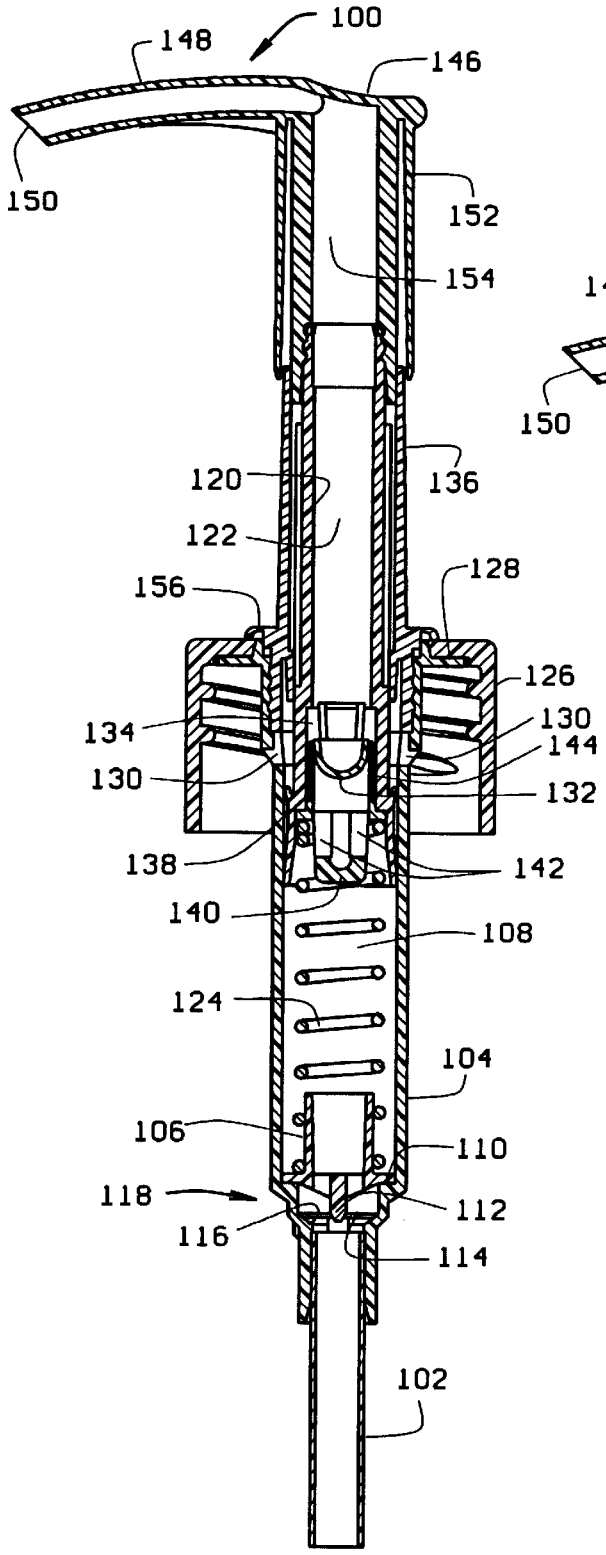
FIG. 7 is a cross-sectional view of a third embodiment of the manually operated liquid dispenser of the present invention showing the plunger in the charge position.
Figure 8:
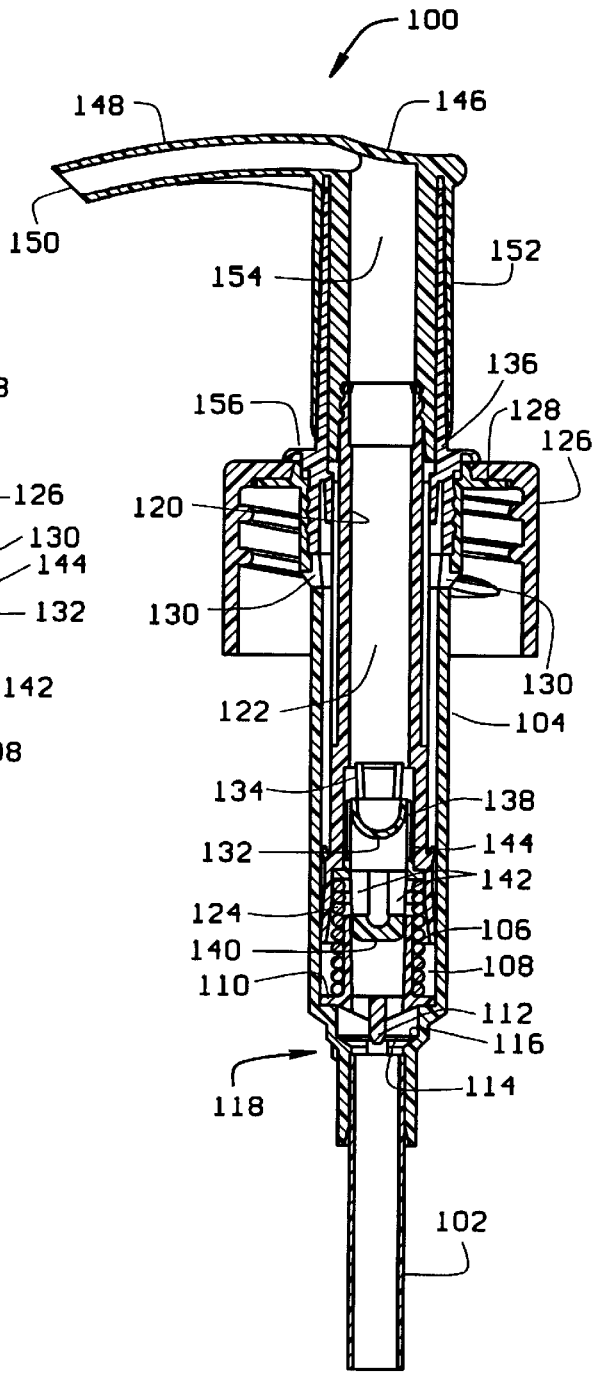
FIG. 8 is a cross-sectional view of a third embodiment of the manually operated liquid pump of the present invention showing the plunger in the discharge position.

Referring to FIGS. 7 and 8, the present invention is generally designated in its entirety by the reference numeral 100. A cylindrical dip tube 102 is connected to a cylindrical pump chamber 104 and is preferably configured for extending downwardly to the bottom of a container (not shown) holding a liquid to be dispensed. A one-piece seal member 106 is within the lower end of a pump chamber interior 108. The seal member includes a base portion 110 sized and configured for being press fit or otherwise secured in the pump chamber interior 108 adjacent to the connection of the dip tub 102 to the pump chamber 104. A protrusion 112 extends downwardly from the base portion, and a thin, generally disc shaped flap 114 extends radially outward from the protrusion 112. Preferably, the flap 114 is of a suitable elastomeric material, such as low density polyethylene (LOPE), so that the thin disc-shaped flap 114 is flexible.

The disc-shaped flap 114 cooperates with an annular shoulder 116 of the pump chamber 104 to form a check valve, generally designated at 118. The disc-shaped check-valve member 114 is moveable between a closed (or seated) position and an open (or unseated) position. In the closed position, the flexible check-valve member 114 sealingly engages the annular shoulder 116 to block fluid communication between the pump chamber interior 108 and the dip tube 102. In the open position, at least a part of the movable check-valve member 114 resiliently flexes upwardly away from the annular shoulder 116 to provide a gap between the moveable check-valve member 114 and the annular shoulder 116 for fluid communication between the dip tube 102 and the pump chamber interior 108.

Mounted to the pump chamber 104 is a plunger 120 having a cylindrical fluid passageway 122 therein. The plunger is configured for reciprocating movement inside the cylindrical pump chamber interior 108 and is biased by a coil spring 124 inside the pump chamber 104. Attached to the pump chamber 104 is a cap 126 configured for threaded attachment to a container (not shown) holding a liquid. A ring 128 is formed at the top of the pump chamber 104 and is configured for seating on the top edge of the container. The threaded cap 126 receives a threaded neck of the container. A pair of vent openings 130 extend through the pump chamber 104 just below the ring 128 to vent the bottle interior through the pump chamber interior.

A downwardly extending protrusion 132 is located generally at a bottom portion of the plunger 120 and under the fluid passageway 122 of the plunger. The protrusion 132 includes lateral slits 134 therethrough for passage of liquid through the slits and into the fluid passageway 122 of the plunger 120.

Attached stationary relative to the pump chamber 104 is a first telescoping sleeve 136 substantially surrounding the plunger in a pump charge position as shown in FIG. 7. The pump charge position coincides with a biased position of the plunger 120 in operation (see FIG. 7), and a pump discharge position coincides with the position of the plunger when it is fully depressed into the pump chamber interior 108, as shown in FIG. 8.

A priming valve 138 is mounted on the plunger 120 adjacent the protrusion 132 of the plunger for movement with the plunger. The protrusion 132 is shaped and configured for acting as a valve seat for the priming valve 138. The priming valve further includes a sealing plug 140 and lateral openings 142 through the sealing plug providing a fluid passage through the priming valve. The priming valve 138 is moveable between a closed position and an open position. In the closed position, a resilient tubular portion 144 sealingly engages the protrusion 132 all around the tubular portion to block fluid communication between the plunger fluid passageway 122 and the pump chamber interior 108. In the open position, at least a part of the tubular portion 144 flexes radially outwardly from the protrusion 132 to provide a gap between the tubular portion and protrusion for fluid communication between the pump chamber interior 108 and the plunger fluid passageway 122.

The sealing plug 140 and priming valve 138 are of a single unitary piece and preferably formed of elastomeric material. The sealing plug 140 is configured to seat against and seal closed the seal member 106 when the plunger is in the discharge position to prevent fluid from flowing upward into the pump chamber interior 108. (See FIG. 8.) Optionally, the invention may be provided with a locking feature to lock the plunger in the discharge position, thereby seating the sealing plug 140 to the sealing member 106 and preventing unintended dispensing of liquid during shipping and handling of the dispenser.

Attached to the plunger 120 is a lotion dispensing head 146 having a discharge conduit 148 and a fluid discharge port 150. Although the dispenser preferably has a lotion head, other heads may be employed without departing from the scope of the invention. For example a spray head might be used to dispense less viscous fluids.

Surrounding and connected to the dispensing head 146 is a second telescoping sleeve 152. The second sleeve 152 telescopes outside the first sleeve 136 as the plunger 120 is reciprocated between its charge (FIG. 7) and discharge (FIG. 8) positions. The second sleeve 152 telescopes over the first sleeve 136 so that the two sleeves form a contiguous water barrier around the plunger 120 when the plunger is in both the charge and discharge positions.

The invention operates as follows. The dispenser 100 is attached to a liquid container (not shown) via the threaded cap 126. As a user first depresses the dispensing head 146, the plunger 120 descends into the pump chamber interior 108. As the pump chamber interior volume decreases, the pressure in the pump chamber increases, opening the priming valve 138 and allowing the air in the pump chamber interior to escape to the plunger fluid passageway 122 via the lateral slits 134 of the protrusion 132. From the plunger fluid passageway 122, the air flows into the dispensing head fluid passageway 154, and ultimately out the discharge port 150 of the discharge conduit 148. The check valve 118 prevents the contents of the pump chamber interior 108 from flowing into the dip tube 102 and thereby into the fluid container. The plunger 120 descends into the pump chamber interior 108 until the plunger reaches its discharge position shown in FIG. 8, whereby substantially all the contents of the pump chamber interior 108 are discharged from the dispenser as described above.

When the dispensing head 146 is released by the user, the spring 124 in the pump chamber interior 108 biases the plunger 120 back to its charge position as shown in FIG. 7. As the plunger ascends the pump chamber interior 108, the interior volume of the pump chamber increases and the pressure in the pump chamber decreases, creating a vacuum in the pump chamber interior 108. This opens the check valve 118 and allows fluid to flow from the dip tube 102 into the pump chamber interior, thereby filling the pump chamber interior with liquid. The priming valve 138 is forced closed by the vacuum in the pump chamber interior, prohibiting fluid flow from the pump chamber interior 108 to the plunger fluid passageway 122.

The dispenser 100 is now ready for use; when a user presses on the dispensing head 146, the plunger 120 descends into the pump chamber interior and the liquid in the pump chamber interior is discharged from the pump chamber interior through the primer valve 138 to the fluid passageway 122 of the plunger 120 via the lateral slits 134 of the protrusion 132. The fluid then flows from the plunger fluid passageway 120 to the dispensing head fluid passageway 154 to the discharge conduit 148 and ultimately out the discharge port 150. When the dispensing head is released by the user, the biasing spring 124 pushes the plunger back to its charge position, creating a vacuum in the pump chamber interior and drawing fluid into the pump chamber interior 108 via the dip tube 102 and the check valve 118. This cycle continues until the fluid container is emptied.

The first sleeve 136 has a configuration at its bottom end that sealably inserts into the pump chamber 104 and thereby shields the connection between the plunger 120 and the pump chamber. The first sleeve 136 also has a fluid deflector 156 which directs fluid away from the connection between the first sleeve and the pump chamber 104. Thus, the first sleeve 136 completely protects the connection between the plunger 120 and the pump chamber 104 and the connection between the pump chamber and the first sleeve 136 from fluid penetration. With the telescopic sleeves in place, water may not reach, let alone penetrate, the connections between the plunger and the pump chamber.

The telescopic sleeves 136, 152 avoid the dilution and contamination problem of the prior art by completely shielding the dispensing fluid passageways from external penetration. In addition to the shielding against water contamination, the sleeves also shield against dirt, dust or other types of particle contamination. The same apparatus or method of shielding a dispenser from foreign fluids could be provided for trigger sprayers with little modification. For example, one sleeve would surround the piston rod or plunger of the trigger sprayer and telescope with a second sleeve that projects from the opening of the pump chamber into which the piston rod extends. Moreover, the benefits of the invention extend well beyond the application of lotion and soap dispensers. Nothing in this application is intended to restrict the application of the telescoping sleeves to lotion or soap dispensers.

In view of the above, it will be seen that the objects of the invention have are achieved and other advantageous results attained.

While the present invention has been described by reference to a specific embodiment, it should be understood that modifications and variations of the invention may be constructed without departing from the cope of the invention defined in the following claims.

What is claimed is:

1. A manually operated liquid dispenser for dispensing liquid from a container, the dispenser comprising:

a pump chamber;

a dip tube in communication with the pump chamber;

a plunger mounted on the pump chamber for reciprocating movement between a charge and discharge position of the plunger relative to the pump chamber;

a first sleeve mounted stationary relative to the pump chamber and surrounding the plunger; and a second sleeve mounted stationary relative to the plunger for reciprocating movement therewith, the second sleeve telescoping with the first sleeve in response to the plunger reciprocating between the charge and discharge positions.

2. The liquid dispenser of claim 1, wherein the first sleeve telescopes inside the second sleeve.

3. The liquid dispenser of claim 1 further comprising a cap mounted to the pump chamber, the cap being configured to attach to a container.

4. The liquid dispenser of claim 1 wherein the first sleeve has opposite ends, one end has a configuration that is inserted into a complementary aperture in the pump chamber and sealably attached to the pump chamber.

5. The liquid dispenser of claim 1 further comprising:

the plunger having opposite ends with one end extending into the pump chamber;

a dispensing head attached to a second end of the plunger opposite the pump chamber, the second sleeve being monolithically formed with the dispensing head.

6. The liquid dispenser of claim 1, wherein:

a portion of the plunger extends outside the pump chamber, the first sleeve is outside the pump chamber, and the first and second sleeves completely enclose the portion of the plunger when the plunger is reciprocated between its charge and discharge positions.

7. The liquid dispenser of claim 1, wherein:

the pump chamber has opposite top and bottom ends, the dip tube extends from the bottom end of the pump chamber and the top end of the pump chamber has an opening;

the plunger has opposite top and bottom ends, the plunger bottom end is mounted in the pump chamber for reciprocating movement therein, the plunger extends from its bottom end through the pump chamber opening to the top end of the plunger outside the pump chamber, and the first sleeve surrounds the top opening of the pump chamber.

8. The liquid dispenser of claim 1, wherein:

the first sleeve has an exterior surface that is exposed to an exterior environment of the liquid dispenser when the plunger is in its charge position relative to the pump chamber and is covered by the second sleeve when the plunger is in its discharge position relative to the pump chamber.

9. The liquid dispenser of claim 1, wherein:

the plunger has opposite first and second ends, the first end is mounted in the pump chamber for reciprocating movement therein and the second end is outside the pump chamber, and the second end projects out of the first sleeve when the plunger is in the charge position relative to the pump chamber and is completely contained in the first sleeve when the plunger is in the discharge position.

10. The liquid dispenser of claim 1, wherein:

the plunger is tubular and has an exterior surface, a portion of the plunger exterior surface reciprocates into and out of the pump chamber, and the first and second sleeves completely enclose the portion of the plunger exterior surface.

11. A method of shielding liquid in a liquid dispenser from dilution and contamination of the liquid, the dispenser having a dip tube communicating with a pump chamber, a plunger mounted on the pump chamber for reciprocating movement between a charge and a discharge position of the plunger relative to the pump chamber, and a pump actuating element mounted to the plunger, the method comprising:

fixing a first sleeve to the pump chamber so that the first sleeve surrounds the plunger;

fixing a second sleeve to the plunger so that the second sleeve is telescoped with the first sleeve when the plunger is in the discharge position and when the plunger is in the charge position.

12. A manually operated liquid dispenser for dispensing liquid from a container, the dispenser comprising:

a pump chamber;

a dip tube communicating with the pump chamber;

a plunger mounted on the pump chamber for reciprocating movement between a charge and a discharge position of the plunger relative to the pump chamber;

a first sleeve connected to the pump chamber, the first sleeve covering the plunger in the charge position; and a second reciprocating sleeve connected to the plunger, the second sleeve being telescoped with the first sleeve when the plunger is in the charge position.

13. The liquid dispenser of claim 12 wherein the second sleeve covers the first sleeve when the plunger is in the discharge position.

14. The liquid dispenser of claim 12 further comprising a dispensing head attached to the plunger, the second sleeve being integrally formed with the dispensing head.

15. The liquid dispenser of claim 12, wherein:

the pump chamber has opposite top and bottom ends, the dip tube extends from the bottom end of the pump chamber and the top end of the pump chamber has an opening;

the plunger has opposite top and bottom ends, the plunger bottom end is mounted in the pump chamber for reciprocating movement therein, the plunger extends from its bottom end through the pump chamber opening to the top end of the plunger outside the pump chamber, and the first sleeve surrounds the top opening of the pump chamber.

16. The liquid dispenser of claim 12, wherein:

the first sleeve has an exterior surface that is exposed to an exterior environment of the liquid dispenser when the plunger is in its charge position relative to the pump chamber and is covered by the second sleeve when the plunger is in its discharge position relative to the pump chamber.

17. The liquid dispenser of claim 12, wherein:

the plunger has opposite first and second ends, the first end is mounted in the pump chamber for reciprocating movement therein and the second end is outside the pump chamber, and the second end projects out of the first sleeve when the plunger is in the charge position relative to the pump chamber and is completely contained in the first sleeve when the plunger is in the discharge position.

18. The liquid dispenser of claim 12, wherein:

the plunger is tubular and has an exterior surface, a portion of the plunger exterior surface reciprocates into and out of the pump chamber, and the first and second sleeves completely enclose the portion of the plunger exterior surface.

19. The liquid dispenser of claim 12 further comprising a cap connected to the pump chamber, the cap being configured for attachment to a container.

20. The liquid dispenser of claim 19 wherein:

the first sleeve has opposite ends with one end telescoping with the second sleeve and an opposite end having a configuration for attachment to the pump chamber forming a watertight seal with the pump chamber.

* * * * *

US005826756B1

REEXAMINATION CERTIFICATE (4203rd)

United States Patent [19] [11] B1 5,826,756

Foster [45] Certificate Issued Nov. 14, 2000

[54] WATER SHIELD FOR PUMP DISPENSER

[75] Inventor: Donald D. Foster, St. Charles, Mo.

[73] Assignee: Continental Sprayers International, Inc., St. Peters, Mo.

Reexamination Request:
No. 90/005,420, Jul. 7, 1999

Reexamination Certificate for:

| | |
|---|---|
| Patent No.: | **5,826,756** |
| Issued: | **Oct. 27, 1998** |
| Appl. No.: | **08/891,540** |
| Filed: | **Jul. 11, 1997** |

Related U.S. Application Data

[63] Continuation-in-part of application No. 08/612,667, Mar. 8, 1996, Pat. No. 5,725,128.

[51] Int. Cl.[7] ..... B65D 88/54

[52] U.S. Cl. ..... 222/321.3; 222/321.9

[58] Field of Search ..... 222/523, 321.3, 222/321.7, 321.9

[56] References Cited

U.S. PATENT DOCUMENTS

| | | |
|---|---|---|
| 3,194,447 | 7/1965 | Brown . |
| 3,949,910 | 4/1976 | Focht . |
| 4,457,455 | 7/1984 | Meshberg . |
| 5,064,102 | 11/1991 | Montaner . |
| 5,316,198 | 5/1994 | Fuchs et al. . |
| 5,335,830 | 8/1994 | Cater . |
| 5,346,103 | 9/1994 | Mizushima et al. . |

*Primary Examiner*—Joseph A. Kaufman

[57] ABSTRACT

A manually operated liquid dispenser having two telescoping sleeves shielding the dispenser fluid passageways from dilution and/or contamination of the fluid being dispensed by a fluid splashed on the exterior of the dispenser.

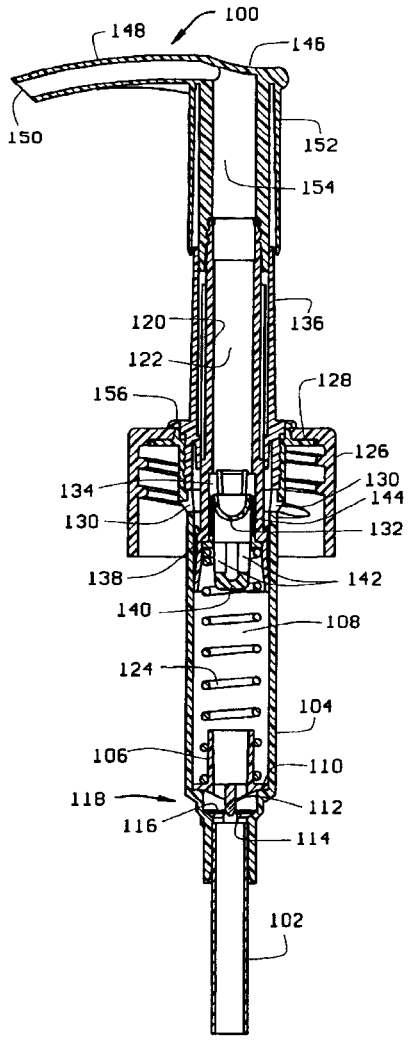

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–20 are canceled.

* * * * *